United States Patent [19]

Jungwirth et al.

[11] Patent Number: 4,469,756

[45] Date of Patent: Sep. 4, 1984

[54] METHOD OF AND APPARATUS FOR FORMING AN OUTWARDLY PROJECTING BULGE IN A STEEL WIRE STRAND FOR FORMING AN ANCHOR IN CONCRETE

[75] Inventors: Dieter Jungwirth, Munich; Lorenz Schnitzler, Pöcking; Alto Mannhart; Johann Wlodkowski, both of Munich, all of Fed. Rep. of Germany

[73] Assignee: Dyckerhoff & Widmann Aktiengesellschaft, Munich, Fed. Rep. of Germany

[21] Appl. No.: 469,303

[22] Filed: Feb. 24, 1983

[30] Foreign Application Priority Data

Mar. 5, 1982 [DE] Fed. Rep. of Germany ..... 3207957

[51] Int. Cl.[3] ..... B23P 25/00; B21C 37/00

[52] U.S. Cl. ..... 428/592; 29/461; 52/223 R; 52/736; 140/105; 428/605

[58] Field of Search ..... 52/223 R, 734, 736; 29/461; 428/592, 605; 140/105

[56] References Cited

U.S. PATENT DOCUMENTS 3,996,020 12/1976 Hosoya ..... 428/592

4,237,942 12/1980 Dietrich ..... 140/105

*Primary Examiner*—W. D. Bray

*Attorney, Agent, or Firm*—Toren, McGeady and Stanger

[57] ABSTRACT

To form a radially outwardly extending bulge in a steel wire strand made up of a plurality of individual wires, the strand is compressed along an axial length so that the individual wires deform radially outwardly and in spaced relation to one another. Compressive force is applied to one end of the strand and the strand is anchored at an axially spaced location from the end. A tubular member with a cylindrically shaped inside surface forms a limiting boundary for the outward movement of the individual wires. The tubular member is located between the end of the strand and the location where it is anchored. The end of the strand and the tubular member are rotatably supported. Each individual wire extends along an angular path about the axis of the strand between the end of the strand and the anchor location.

16 Claims, 6 Drawing Figures

METHOD OF AND APPARATUS FOR FORMING AN OUTWARDLY PROJECTING BULGE IN A STEEL WIRE STRAND FOR FORMING AN ANCHOR IN CONCRETE

SUMMARY OF THE INVENTION

The present invention is directed to a method of forming a radially outwardly directed bulging section in a steel wire strand for anchoring the strand in a concrete structural member. The method involves compressing a strand in the axial direction along a given length so that the individual wires are deformed radially outwardly. Further, the invention is directed to the apparatus for performing the method and to the form of the outwardly bulging section.

In addition to steel rods, steel wires and bundles of steel wire, recently strands of high strength steel wires have found increasing use as reinforcing members for reinforced concrete and prestressed concrete. Such strands are usually formed of a central or core wire around which outer wires are wound in one or more annular layers, with the outer wires twisted as in a wire cable.

Usually such strands, acting as tendons, are anchored with wedge-anchoring systems. Wedge-anchoring systems are relatively complicated with regard to the parts involved as well as with regard to the time required for installation. The economics of such systems are a particularly important factor when the anchor for the strand is to be firmly embedded in concrete, that is, when the tendon does not need to be stressed at the anchor location. Further, in wedge-anchoring systems it is difficult to attain an adequate vibration strength without using some additional measures.

For anchoring a prestressing cable, formed of several strands, in concrete, it is known to unwrap the individual strands by twisting after radially fanning them out and to insert a spacer between the spread wires so that a localized outward bulge results under the elastic deformation of the wires, note French Pat. No. 1,551,162. The diameter of the bulge produced in this manner, is relatively small and the distance between the wires is small, whereby when the bulge is embedded in concrete there is the possibility that the individual wires may not be completely surrounded or enclosed in concrete. Since the individual wires of each strand are only elastically deformed, the radii of curvature of the bulge are large which does not impair the strength, particularly the vibration strength, however, it leads to a considerable length of the anchor.

It is also known to axially compress a strand so that the individual wires bend laterally outwardly under plastic deformation and form a bulge in the configuration of a double cone, note German Pat. No. 25 57 072. While the diameter of the bulged section can be selected such that the concrete can easily penetrate into the interior of the bulged section and closely enclose the individual wires, there is always the danger, due to the bending of the wires, that at the starting end of the bulged section the plastic deformation of the wires is so great that their tensile strength and dynamic strength are reduced. The sum of the angles of deflection, generated when the wires are bent, is too small to take up the full rupture load. To guarantee the safety of the anchor under such circumstances, usually a so-called leading length is provided, that is, before the bulged section a straight section is positioned in which a part of the anchoring force is attained by bonding, so that at the beginning section of the bulged section the complete anchoring force is no longer available.

To limit the bonding radius at the starting point of the bulged section, that is, where the full tension still exists, it is known in the formation of the bulged section with an approximately pear-shaped configuration to determine the curvature of the wires where the outward widening begins, such as by using a curvature matrix, note German Offenlegungsschrift No. 27 55 454. In this anchor arrangement for a strand, the wires in the remainder of the bulged section experience a relatively strong curvature with inwardly directed bearing pressures which generate a spatial state of compressive stress in the concrete enclosed within the pear-shaped bulged section.

Therefore, the primary object of the present invention is to form an outwardly bulged section which provides the required anchoring of the strand so that the introduction of the anchoring forces takes place as smoothly and uniformly as possible over an axial length which is as short as possible.

In accordance with the present invention, the outwardly bulged section of the strand is produced over at least a portion of the axial length of the section with the largest outside diameter formed by the inside surface of a hollow space defined by a cylindrical jacket or open-ended tubular member. The cylindrical jacket extends coaxially with the axis of the strand and its inside surface is spaced radialy outwardly from the outside surface of the strand. When the strand is compressed over a given axial length the strand wires move radially outwardly due to the compression and contact the inside surface of the jacket. With the individual wires in contact with the inside surface of the jacket, the compressive force is continued and the strand is rotatably held at its free end until the outwardly bulged section is completed.

Preferably, the wires of the strand are held together at their free end by means of a sleeve, that is, at the end where the compressive force is applied.

The invention is based on the knowledge that due to limiting the radial widening of the bulged section taking place because of axial compression, in a simple manner it is possible to prevent the individual wires from bending continuously in the radial direction and instead it forces the wires into a spatial deformation. If the outward movement of the bulged section is limited in accordance with the present invention, the individual wires of the strand contact the inside surface of the cylindrical jacket and, during further axial compression, continue to wind around in the direction of the predetermined twisting of the strand in its original form. Consequently, the sections of the individual wires which extend along the inside surface of the cylindrical jacket and thus along the outside surface of the bulged section are prevented from having more or less sharp bends. Further, from the starting point of the bulged section a uniform, slowly increasing, spatial curvature of the individual wires of the strand is achieved. This spatial curvature of the individual wires results in a continuous transition from the axially extending rectilinear course of the strand to a lesser curvature and then to a greater curvature. In the bulged section formed according to the invention, due to the spatial curvature of the individual wires, the total of the deflecting angles is quite large. From the starting point to the end point of the bulged section the individual wires form an angle of approximately 270° about the axis of the strand. As a result, there is an increase of the bonding action due to the rope friction effect so that an anchor with a very good permanent vibration behavior is possible in the shortest time and without a leading length.

By holding the free end of the strand in a sleeve which forms the starting point of the bulged section, a greater strength or greater diameter of the individual wires is assured along with a reduced relative surface of the anchor which is effective and safe in use.

The present invention is also directed to an apparatus for carrying out the method. The strand to be compressed is held between clamping jaws and a pressure member is located at an axially spaced distance from the jaws and it includes a bore for receiving and supporting the end of the strand. The pressure member is movable toward the clamping jaws for transmitting compressive force to the strand. Spaced between the end of the strand and the clamping jaws is a compression tube or cylindrical jacket coaxial with and spaced radially outwardly from the axis of the strand.

Preferably, the compression tube or jacket is supported so that it is rotatable about its axis and is also slidable or movable in the axial direction.

The invention is further directed to the spatial configuration of the bulged section.

The various features of novelty which characterize the invention are pointed out with particularity in the claims annexed to and forming a part of this disclosure. For a better understanding of the invention, its operating advantages and specific objects attained by its use, reference should be had to be accompanying drawings and descriptive matter in which there are illustrated and described preferred embodiments of the invention.

DETAILED DESCRIPTION OF THE INVENTION

Figure 3:
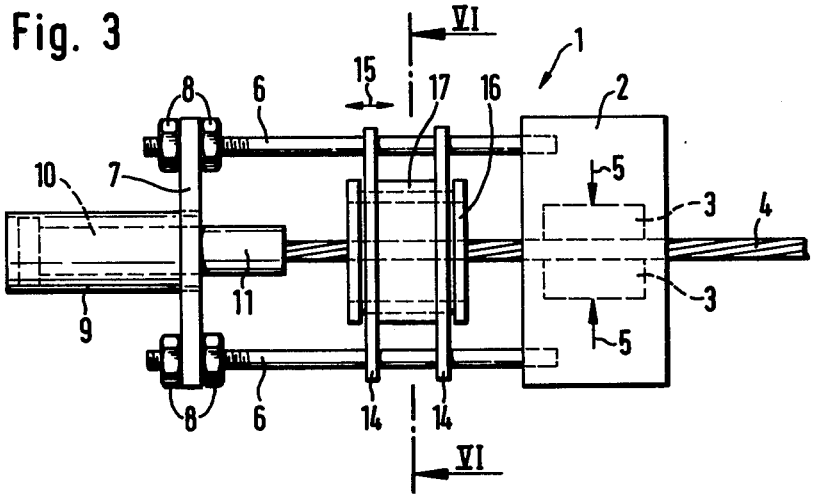
FIG. 3 is a top view of an apparatus for carrying out the method of the present invention.
Figure 4:
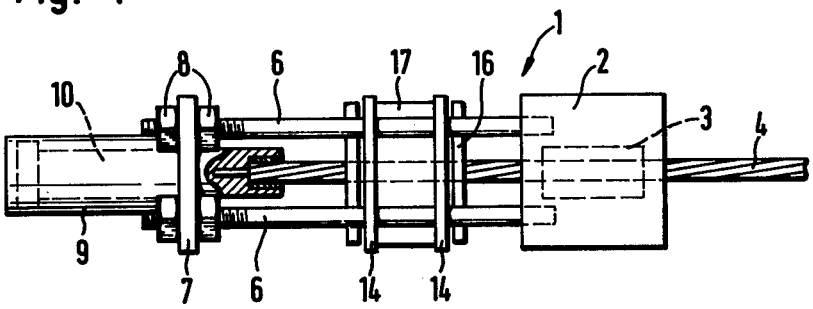
FIG. 4 is a side view of the apparatus shown in FIG. 3.

In FIGS. 3 and 4 a top view and a side view are shown of an apparatus for performing the method of the present invention.

A compression apparatus 1 includes an abutment block 2 which is not a feature of the present invention and may be of any known construction. In the illustrated embodiment, the abutment block 2 mounts a pair of clamping jaws 3, shown schematically, which can be moved inwardly toward a strand 4 in the direction of the arrows 5 for clamping the strand over a considerable axial length thereof.

Figure 5:
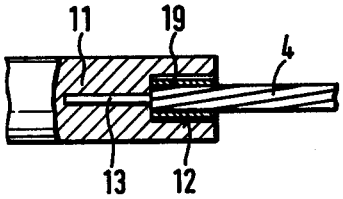
FIG. 5 is an enlarged side view, partly in section, of a part of the apparatus shown in FIGS. 3 and 4.

The ends of four spaced guide rods 6 are secured to the abutment block 2, for instance they can be screwed into the block. The guide rods 6 extend from the abutment block in generally parallel relation with the axis of the strand 4. At the opposite ends of the rods 6 from the abutment block 2 a cover plate 7 is located and it is held on the rods by nuts 8. A cylinder-piston unit 9 is supported on the cover plate 7 and the unit includes a piston rod 10 with a pressure member 11 at one end. As can be seen in FIGS. 4 and 5, the pressure member 11 has a bore 12 in its end face, directed toward the abutment block 2, for receiving the strand 4. The bore 12 continues into the pressure member 11 as a reduced diameter bore 13 for holding the core wire of the strand 4, note FIG. 5.

Figure 6:
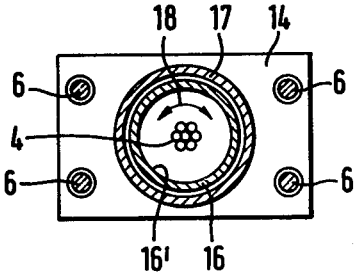
FIG. 6 is a sectional view taken along the line VI—VI in FIG. 3.

Two guide plates 14 spaced apart in the axial direction of the strand are movably mounted on the guide rods 6 so that they can be moved in the direction of the double-headed arrow 15 shown in FIG. 3. A compression tube 16 in the form of a cylindrical jacket open at its end extends between and is mounted in the plates 14. The tube 16 is rotatably supported in the direction of the double-headed arrow 18 shown in FIG. 6. The tube 16 is rotatably supported inside a spacer tube 17 mounted in the plates 14.

When using the apparatus 1, after inserting the strand 4 into the bore 12 of the pressure member 11, first, clamping jaws are moved towards one another in the direction of the arrows 5 and the strand is held in the clamped position. Next, the cylinder-piston unit 9 is actuated. During the movement of the piston, the pressure member 11 moves in the axial direction of the strand toward the abutment block 2 so that the strand 4 is compressed between the pressure member 11 and the abutment block 2.

Due to the compressive force applied, the individual wires of the strand 4 move radially outwardly from the strand axis and this outward movement is limited by contact with the inside surface of the cylindrical jacket or compression tube 16. During the continuation of the application of the compressive force over a specific distance, the individual wires of the strand 4 move outwardly into contact with the inside surface of the tube 16 which, due to its rotatable support inside the spacer tube 17 and its ability to slide axially along the guide rods 6, rotates along during the continued compressive movement and, if necessary, also moves in the axial direction. The strand is rotatably supported in the pressure member 11 and generally the rotatably support of the piston 10 in the cylinder-piston unit 9 is adequate and, during the continued application of compressive force, a spatial deformation takes place in the sense of the twisting of the individual wires which are prevented from further outward movement by the inside surface of the tube 16 with the result that the configuration of the outwardly bulged section results as is shown in FIGS. 1 and 2.

Figure 1:
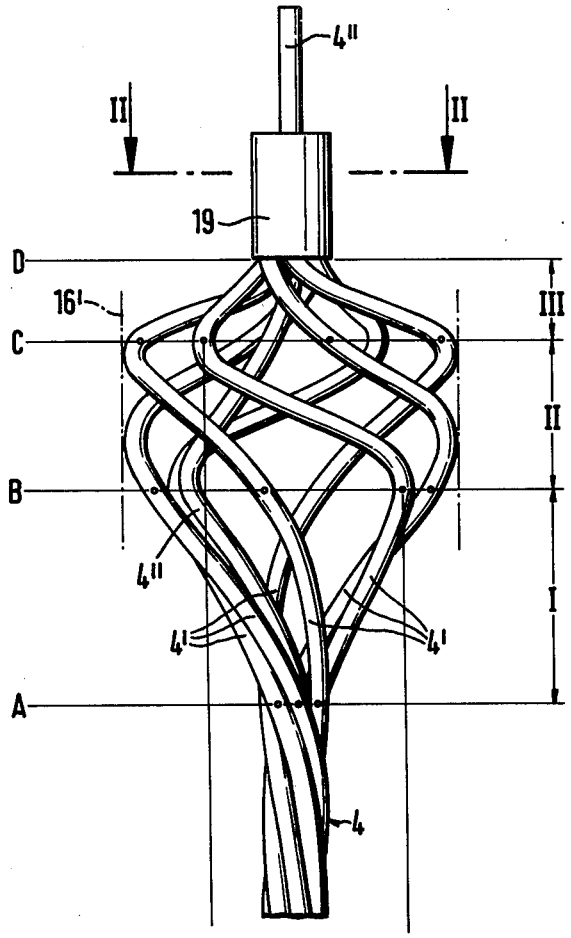
FIG. 1 is a side view of a bulged section of a strand formed in accordance with the present invention.
Figure 2:
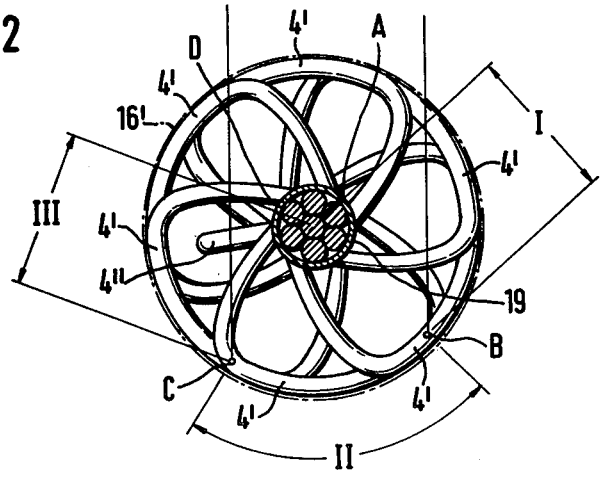
FIG. 2 is a sectional view taken along the line II—II in FIG. 1.

Because of the above-desired twisting or turning of the individual wires around the axis of the strand during the compressing step, the strand develops an outwardly bulged configuration, as shown in FIGS. 1 and 2, where the individual wires describe spatial curves each constructed differently in the axially extending regions of the bulged section. As viewed in FIG. 1, starting with a section in plane A extending transversely of the axial direction of the strand, the individual wires are located in the original form of the strand 4, in an axially extending region I extending between the plane A and the adjacent plane B, the individual outer wires 4' expand in a trumpet-like manner while turning in the same direction of rotation as the twist of the individual wires forming the strand 4. In the next axially extending region II extending between the planes B and C, the outer individual wires 4' extend helically on the inside surface 16' of the cylindrical jacket forming the compression tube 16. The diameter of these wires 4' around the axis of the strand is determined by the inside diameter of the cylindrical jacket. The inside surface 16' of the cylindrical jacket or compression tube 16 is shown in a broken line in FIGS. 1 and 2. After a somewhat sharper curvature of the individual wires in the sectional plane C, the wires 4' in the axial region III into the plane D where, with a relatively sharp bend, they end up in the end stub of the strand 4 held in sleeve 19 within the bore 12 in the pressure member 11.

Due to the twisting of the strand during the compression operation, the angles of the individual wires 4' relative to the axis of the strand is relatively small in plane A as the individual wires are bent out of their normal position in the strand. The position of the individual wires 4' can be exactly determined by the ratio of the compression tube diameter to the free length of the strand over which it is compressed, that is the length as shown in FIG. 3 between the pressure member 11 and the clamping jaws 3. Accordingly, bends or other damage to the individual wires 4' are definitely prevented so that the outwardly bulged section in this region can be stressed with the full anchoring force.

Due to the twisting action experienced by the strand, a spatial curvature of the individual wires 4' with a continuous transition from the flat curvature to the sharper curvature results in two successive sharp curves of approximately 90° which are spaced from one another angularly by approximately 90° and these curvatures assure, due to the low friction effect, a high force transmission. These sharp curves lie in the region in which a large portion of the anchoring forces are taken up by the preceding flatter curves.

The form of the core wire 4'' may be varied. Since the core wire is held within the smaler bore 13 forming a continuation of the larger bore 12, it is compressed at a different point than the other wires, and it does not interfere with the other wires nor does it cause any displacement of the wires. The core wire 4'' extends, after the compressive operation has been completed, inside the outwardly bulging section, note FIGS. 1 and 2.

While specific embodiments of the invention have been shown and described in detail to illustrate the application of the inventive principles, it will be understood that the invention may be embodied otherwise without departing from such principles.

We claim:

1. A method of forming an outwardly projecting axially extending bulged section in an axially extending strand of steel wires made up of a plurality of individual wires so that the bulged section can be used to anchor the strand in a concrete structural member, comprising axially compressing a given length of the strand and deforming the individual wires as they move radially outwardly from the axis of the strand, wherein the improvement comprises providing an axially extending open-ended cylindrically shaped member forming an cylindrical limiting hollow space for defining the maximum diameter of the bulged section transverse to the axial direction of the strand, rotatably supporting the cylindrically shaped member, extending the strand through the hollow space with the axis of the strand centered within the hollow space, applying a compressive force to one end of the strand and rotatably supporting the strand at the end at which the compressive force is applied for deforming the individual wires of the strand outwardly into contact with the inside surface of the cylindrically shaped member limiting the hollow space, and continuing the application of the compressive force while the individual wires turn around the axis of the strand in contact with the inside surface of the cylindrically shaped member.

2. A method, as set forth in claim 1, including securing the individual wires of the strand together at the end at which the compressive force is applied to the strand.

3. A method, as set forth in claim 1, axially movably supporting the cylindrically shaped member.

4. A method, as set forth in claim 1, including anchoring the strand at a position spaced axially from the end at which the compressive force is applied.

5. A method, as set forth in claim 1, wherein the strand is formed of an axially extending core wire and a plurality of individual wires twisted around the core wire.

6. Apparatus for forming an outwardly projecting bulged section in an axially extending length of a strand of steel wires made up of a plurality of individual wires, comprising a first means for applying a compressive force to one end of said strand, second means for clamping the strand spaced axially from said first means, said first means being movable toward said second means, said first means including a bore for receiving and supporting the end of the strand, wherein the improvement comprises an open ended tubular member located between said first and second means and centered relative to the strand arranged to extend between said first and second means with the inside surface of said tubular member spaced radially outwardly from the outside surface of the strand to be compressed.

7. Apparatus, as set forth in claim 6, wherein said tubular member is rotatably supported for rotation about the axis of the tubular member and the axis of the strand.

8. Apparatus, as set forth in claim 7, wherein said tubular member is supported to be axially movable in the direction between the first and second means.

9. Apparatus, as set forth in claim 6, wherein said first means comprises a piston unit including a piston rod and a sleeve located on the end of said piston rod, said sleeve having a bore therein for receiving the strand to be compressed, said piston rod being axially displaceable toward said second means, said second means comprising an abutment block, clamping jaws mounted on said abutment block for clamping the strand, a plurality of rods extending between and interconnecting said piston unit and said abutment block, plates axially movably mounted on said rods, and said tubular member is rotatably supported in said plates.

10. An anchoring bulged section for a strand of steel wires made up of a number of individual wires where an axial length of the strand is compressed to form the individual wires radially outwardly from the original state of the strand with the individual wires disposed in spaced relation to one another between a first location and a second location spaced apart in the axial direction of the strand, comprising that in the direction extending from the first location to the second location the individual wires are deformed radially outwardly from the axis of the strand in the original state to an axially extending region where the individual wires forming the bulged section have a maximum diameter outwardly from the strand axis and from the opposite end of said axial extending region from the first location the individual wires are inclined radially inwardly toward the axis of the strand until the individual wires resume their original position in the strand at the second location, and said individual wires have a greater angle relative to the axis of the strand from the end of the axially extending region adjacent to the second location to the second location than the individual wires extending from the first location to the end of the axially extending region closer to the first location.

11. An anchoring bulged section, as set forth in claim 10, wherein between the first and second locations the individual wires traverse an angle of approximately 270° about the axis of the strand.

12. An anchoring bulged section, as set forth in claim 10, wherein said strand has a free end positioned at the second location and the compressive force is applied to the free end of the strand.

13. An anchoring bulged section, as set forth in claim 10, wherein the axial length of the bulged section from the first location to the adjacent end of the axially extending region is greater than the axial length from the opposite end of the axially extending section to said second location.

14. An anchoring bulged section, as set forth in claim 10, wherein each individual wire extends around the axis of the strand for approximately 90° in said axially extending region.

15. An anchoring bulged section, as set forth in claim 10, wherein said strand comprises a core wire and a plurality of said individual wires twisted around said core wire.

16. An anchoring bulged section, as set forth in claim 10, wherein said axially extending region has the same diameter for the axial length thereof.

* * * * *